United States Patent [19]

Woodward

[11] 4,103,262

[45] Jul. 25, 1978

[54] DUAL CHANNEL TRANSMISSION OF MICROWAVE POWER THROUGH AN INTERFACE OF RELATIVE ROTATION

[75] Inventor: Oakley McDonald Woodward, Princeton, N.J.

[73] Assignee: RCA Corporation, New York, N.Y.

[21] Appl. No.: 730,333

[22] Filed: Oct. 7, 1976

[51] Int. Cl.[2] ..... H01P 5/12

[52] U.S. Cl. ..... 333/6; 333/97 R; 333/98 TN

[58] Field of Search ..... 333/1, 6, 9, 97 R, 98 TN

[56] References Cited

U.S. PATENT DOCUMENTS

| | | | |
|---|---|---|---|
| 2,853,681 | 9/1958 | Smoll | 333/6 |
| 3,728,648 | 4/1973 | Lerner | 333/6 |
| 4,005,379 | 1/1977 | Lerner | 333/6 |

*Primary Examiner*—Paul L. Gensler

*Attorney, Agent, or Firm*—H. Christoffersen; Joseph D. Lazar; Leonard Weiss

[57] ABSTRACT

Similar input and output mode exciters are each comprised of a coaxial line having an inner conductor and an outer conductor. The coaxial lines have proximal ends coupled through a coupling assembly whereby one of the mode exciters is axially rotatable relative to the other. There are eight coaxial ports in each of the outer conductors. The ports of the input mode exciter and the ports of the output mode exciter are connected to similar first and second bilateral networks, respectively. Additionally, a pair of terminals of the first network are respectively connected to first and second signal sources, whereby input signal power is applied to the input mode exciter through the first network. In response to the application of the input power, a pair of terminals of the second network provide output power independent of the relative rotational position of the mode exciters.

6 Claims, 6 Drawing Figures

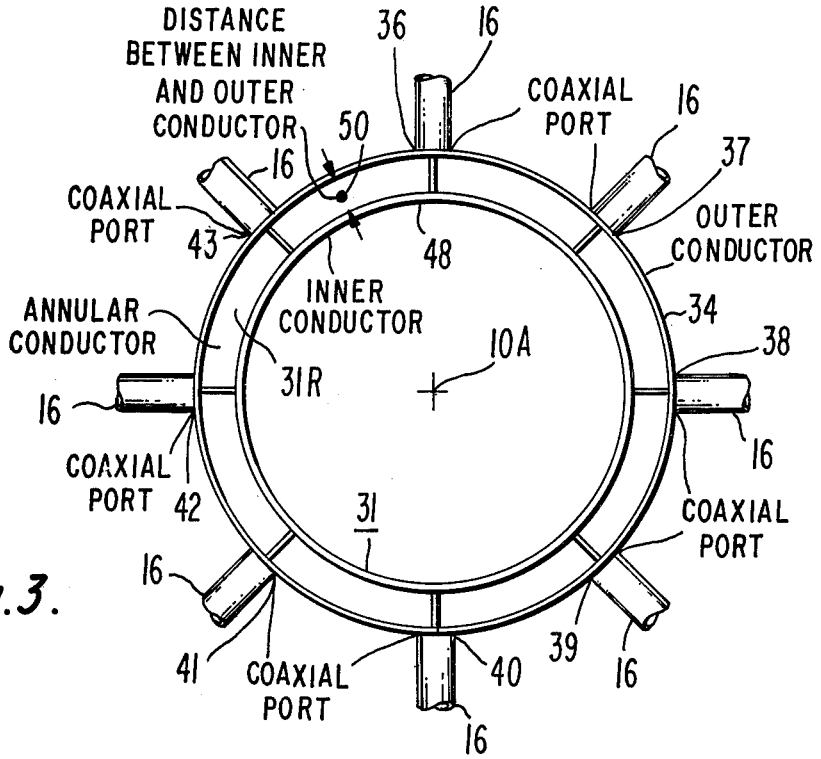
Fig.3.
Fig.4.
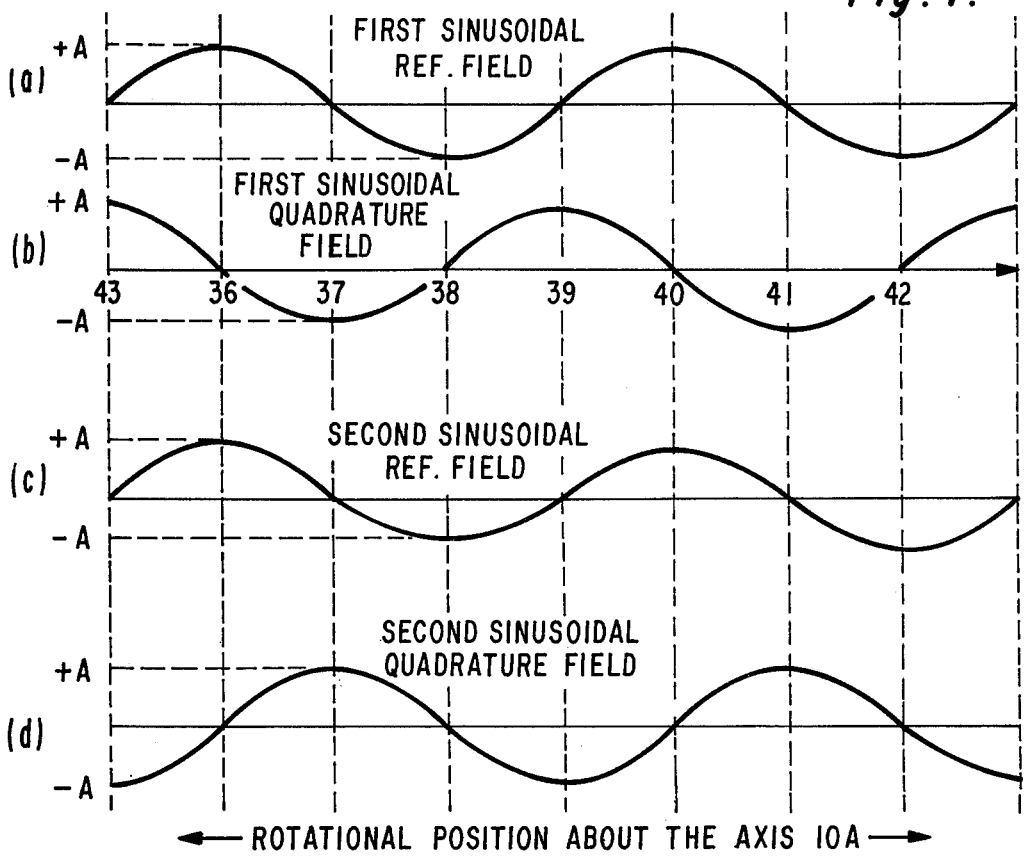

DUAL CHANNEL TRANSMISSION OF MICROWAVE POWER THROUGH AN INTERFACE OF RELATIVE ROTATION

BACKGROUND OF THE INVENTION

1. Field of the Invention

This invention relates to transmission of electrical signals and more particularly to transmisison of signals at a microwave frequency through an interface comprised of members that are relatively rotatable.

2. Description of the Prior Art

In a space communication system, for example, it may be necessary to transmit electrical signals at a microwave frequency from a stationary power source, through a single channel of what is known as an interface of relative rotation, to a rotatable antenna. When the signal is transmitted through slidable contacts, such as brushes and slip rings, the slidable contacts generate noise signals and dissipate a substantial amount of power. For this reason, slidable contacts are not desirable as the interface of relative rotation.

Preferably, the interface of relative rotation includes a coupling assembly that is connected to proximal ends of a pair of coaxial transmission lines. The coupling assembly has noncontacting, overlapping sleeves of a length equal to one quarter of a wavelength associated with the transmitted signal, whereby the sleeves provide a noncontacting electrical coupling between the lines. Additionally, the coupling assembly maintains the lines in axial alignment with one of the lines axially rotatable with respect to the other. The coupling assembly and the lines comprise what is known in the art as a rotary joint.

In constructing such a rotary joint, it is desirable to make the lines with as large a diameter as possible, thereby preventing either an over heating or a breakdown of the lines when the signal is transmitted at a high power level. However, when the diameter of the lines is too large, there may be an undesired mode of transmission through the rotary joint, thereby causing a substantial power loss within the lines. Additionally, power transmitted through the rotary joint may be a function of a rotational position of one of the lines relative to the other. Therefore, there is usually a well defined limit to the diameter of the coaxial transmission lines.

It is often desirable to transmit signals from two sources through two channels of the interface of relative rotation. When a rotary joint is constructed with two channels, it is complex and, additionally, has a size that is limited for reasons similar to those given above.

SUMMARY OF THE INVENTION

According to the present invention, a first inner cylindrical conductor is coaxially disposed within a first outer cylindrical conductor, and a second inner cylindrical conductor is coaxially disposed within a second outer cylindrical conductor. The conductors are connected to a coupling assembly of the type that provides for an axial rotation of the first conductors relative to the second conductors and provides a noncontacting coaxial coupling therebetween. Within the first and the second outer conductors, 4H ports are disposed with equal arcuate spacing therebetween, H being an integer greater than one.

In one specific embodiment, a first bilateral network is connected to the ports of the first outer conductor.

Additionally, a second bilateral network, similar to the first network, is connected to the ports of the second outer conductor. In response to input signal power from first and second sources being applied, respectively, to a pair of terminals of the first network, output power is provided by the second network.

DESCRIPTION OF THE DRAWING

FIG. 3 is a view of FIG. 2 taken along the line 3—3.

FIG. 4 is a graphical showing of waveshapes of electrical fields established within the rotary joint of FIG. 2.

DESCRIPTION OF THE PREFERRED EMBODIMENT

In an exemplary embodiment of the present invention, microwave power from two sources is transmitted through a hollow rotary joint. The rotary joint includes transmission lines with a circumference in an approximate range of two to four wavelengths of electromagnetic energy associated with the transmitted microwave power. In an alternative embodiment, the lines may have a larger circumference. Since the rotary joint is hollow, a waveguide or other network may be disposed within the rotary joint.

Figure 1:
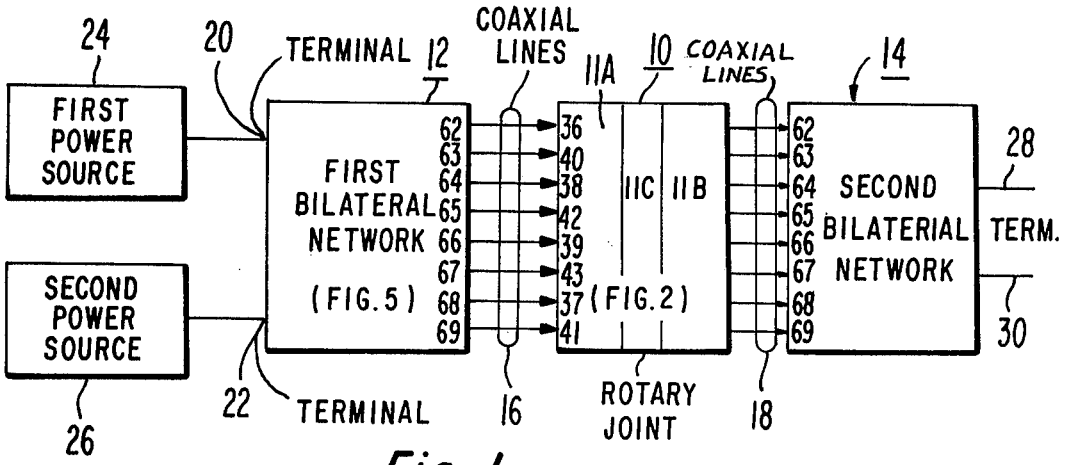
FIG. 1 is a block diagram of a preferred embodiment of the present invention.
Figure 2:
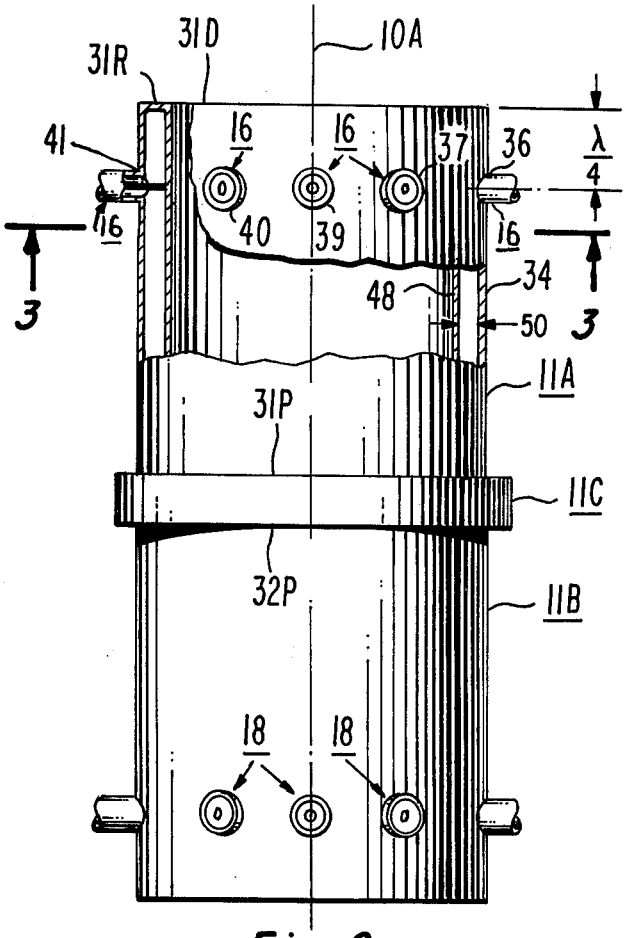
FIG. 2 is a side elevation, partially in section, of a rotary joint of the embodiment of FIG. 1.

Referring to FIGS. 1–3, there is shown a rotary joint 10 which has eight input ports and eight output ports connected to a first bilateral network 12 and to a second bilateral network 14 (similar to the network 12) through coaxial lines 16, 18, respectively. In an alternative embodiment, waveguides rather than coaxial lines, connect the networks 12, 14 to a rotary joint. Network 12 has input terminals 20, 22 that are connected to a first voltage source 24 and to a second voltage source 26, respectively, whereby input voltages are applied to the rotary joint 10 through the network 12. In this embodiment, the sources 24, 26 provide voltages at frequencies that differ from each other. Output power derived from the sources 24, 26 is provided by the network 14 at terminals 28, 30, thereof, respectively.

The rotary joint 10 is comprised of an input mode exciter 11A and an output mode exciter 11B (similar to the mode exciter 11A) that have proximal ends 31P, 32P, (FIG. 2), respectively, connected together through a coupling assembly 11C. The coupling assembly 11C is of the type with noncontacting, overlapping sleeves described hereinbefore, whereby the mode exciters 11A, 11B are maintained in axial alignment, axially rotatable relative to each other and coaxially coupled together via the sleeves. Moreover, the mode exciters 11A, 11B and the coupling assembly 11C are all substantially hollow coaxial cylindrical structures with a common axis 10A.

Mode exciter 11A includes a cylindrical outer conductor 34 (FIGS. 2 and 3) in which ports 36–43 are disposed with equal arcuate spacing therebetween. The mode exciter 11A additionally includes an inner cylindrical conductor 48 coaxially disposed within the conductor 34 at a distance 50 therefrom, whereby the conductors 34, 48 form a coaxial transmission line. Because of the coupling assembly 11C, the conductors 34, 48 are respectively coupled to corresponding conductors (not shown) of the mode exciter 11B. As explained hereinafter, the conductors 34, 48 couple microwave power through the coupling assembly 11C to the mode exciter 11B.

A feature of power transmission through the rotary joint 10 is that the application of the input voltages establish two electric fields (referred to hereinafter as first and second constant fields) between the conductors 34, 48. The constant fields have constant strengths with respect to angular position about the axis 10A. Additionally, the lines of force of the constant fields are all radial with respect to the axis 10A. The first and second constant fields are established in response to voltages derived from the sources 24, 26, respectively, as explained hereinafter.

Referring to FIG. 4, the first constant field is illustrated as a pair of electric fields that are referred to as a first sinusoidal reference field and a first sinusoidal quadrature field. The first reference field (FIG. 4, illustration (*a*)) has a maximum strength (+A) near the ports 36, 40, a maximum strength (−A) near the ports 38, 42, and zero strength near the ports 37, 39, 41, 43. Additionally, lines of force of the first reference field are all radial with respect to the axis 10A whereby the first reference field has a mode of propagation that is parallel to the axis 10A.

A metal annulus 31R is connected to the conductors 34, 48, at a distal end 31D of the mode exciter 11A. Moreover, the ports 36–43 are disposed approximately one-quarter of a wavelength (associated with a frequency of a voltage applied to the network 12) from the end 31D as shown in FIG. 2. Therefore, when a portion of electromagnetic energy associated with the first reference field propagates to the annulus 31R, it is reflected therefrom towards the coupling assembly 11C thereby increasing propagation towards the coupling assembly 11C.

To provide the first reference field, a first in-phase reference voltage, derived from the source 24, is provided to ports 36, 40 by the network 12. Additionally, a first out-of-phase voltage, that is 180° out-of-phase with the first in-phase voltage, is provided to the ports 38, 42 by the network 12. Moreover, the spacing between adjacent ones of the ports 36–43 and the distance 50 are in accordance with a pair of mode relationships which are given as:

$$\lambda/2 > b > \lambda/4 \quad (1)$$

$$a < \lambda/2 \quad (2)$$

where $b$ equals the arcuate spacing between each of the adjacent ones of the ports 36–43;

$a$ equals the distance 50; and $\lambda$ is a wavelength associated with a frequency of a voltage to the network 12.

It should be appreciated that the mode relationships (1) and (2) are similar to relationships applicable to a rectangular waveguide that supports a $TE_{10}$ mode of propagation, wherein the arcuate spacing ($b$) and the distance 50 ($a$) are analogous to the inside width and height of the waveguide, respectively.

Because the spacing between adjacent ones of the ports 36–43 and the distance 50 are in accordance with the mode relationships (1) and (2), the first reference field is provided in response to the first reference voltages. Additionally, the spacing between the adjacent ones of the ports 36–43 causes the circumference of the conductor 34 to be in a range of two to four wavelengths.

Since the first reference field is sinusoidal (FIG. 4, illustration (*a*)), the strength of the first reference field is in accordance with a first reference relationship which is given as:

$$V_{A1} = A \cos \theta \quad (3)$$

where $V_{A1}$ is the strength of the first reference field;

$\theta$ is an angle about the axis 10A measured from the port 36 in a direction of angular progression towards the port 37; and $A$ is the maximum strength of the first reference field.

The first quadrature field (FIG. 4, illustration (*b*)) referred to hereinbefore, has a maximum strength (−A) near the ports 37, 41, a maximum strength (+A) near the ports 39, 43, and zero strength near the ports 36, 38, 40, 42. It should be appreciated that the first quadrature and first reference fields have equal strengths.

Lines of force of the first quadrature field are all radial with respect to the axis 10A (similar to the first reference field). Moreover, electromagnetic energy associated with the first quadrature field propagates through the coupling assembly 11C for reasons similar to those given in connection with the first reference field.

The first quadrature field is provided in response to a first positive quadrature voltage and a first negative quadrature voltage, both of which are derived from the source 24. The first positive quadrature voltage has a phase angle of plus ninety degrees with respect to the first in-phase reference voltage and is provided to the ports 39, 43 by the network 12. The first negative quadrature voltage has a phase angle of minus ninety degrees with respect to the first in-phase reference voltage and is provided to the ports 37, 41 by the network 12.

For the reasons similar to those given in connection with the first reference field, the first quadrature field (FIG. 4, illustration (*b*)), is established in accordance with a first quadrature relationship which is given as:

$$V_{B1} = -j A \sin 2\theta \quad (4)$$

where $V_{B1}$ is the strength of the first quadrature field; and $j$ is a quadrature operator.

Since the first reference and first quadrature voltages are both derived from the source 24, the first reference and first quadrature fields are additively combined in a manner represented by an addition of the terms of the first reference and the first quadrature relationships; the addition is in accordance with a first constant field relationship which is given as:

$$V_{C1} = V_{A1} + V_{B1} \quad (5)$$

$$= A \cos 2\theta - j A \sin 2\theta \quad (6)$$

$$= A_e - j 2\theta \quad (7)$$

where $V_{C1}$ is the strength of the first constant field.

Because the first quadrature relationship is a negative term, the phase of the first constant field changes negatively with respect to the direction of angular progression about the axis 10A from the port 36 to the port 37. However, the first constant field has the same strength (A) at all angles about the axis 10A whereby the strength of the first constant field is independent of angular position about the axis 10A. Moreover, because the first constant field is a sum of the first reference and the first quadrature fields, electromagnetic energy associated with the first constant field propagates through the coupling assembly 11C to ports of the mode exciter 11B whereby power is transmitted through the rotary joint 10.

Similar to the first constant field, the second constant field is comprised of a second sinusoidal reference field (FIG. 4, illustration (*c*)), and a second sinusoidal quadrature field (FIG. 4, illustration (*a*)), both of which have maximum strengths equal to the strength of the first reference field. Additionally, the lines of force of the second fields are radial with respect to the axis 10A. Therefore, electromagnetic energy associated with the second constant field propagates through the coupling assembly 11C for reasons similar to those given in connection with the first constant field.

To provide the second reference field, a second in-phase reference voltage, derived from the source 26, is provided to the ports 36, 40 by the network 12. Additionally, a second in-phase reference voltage, 180 degrees out of phase with the second in-phase reference voltage, is provided to the ports 38, 42 by the network 12. Because the spacing between adjacent ones of the ports 36–43 and the distance 50 are in accordance with the mode relationships, the second reference field is provided in response to the second reference voltages.

Since the second reference field is sinusoidal (FIG. 4, illustration (*c*)), the strength of the second reference field is in accordance with a second reference relationship which is given as:

$$V_{A2} = A \cos \theta \tag{8}$$

where $V_{A2}$ is the strength of the second reference field.

The second quadrature field (FIG. 4, illustration (*d*)) referred to hereinbefore, has a maximum strength (+A) near the ports 37, 41, a maximum strength (−A) near the ports 39, 43, and zero strength near the ports 36, 38, 40, 42. The second quadrature field is provided in response to a second positive quadrature voltage and a second negative quadrature voltage, both of which are derived from the source 26. The second positive quadrature voltage has a phase angle of plus ninety degrees with respect to the second in-phase reference voltage and is provided to the ports 37, 41 by the network 12. The second negative quadrature voltage has a phase angle of minus 90 degrees with respect to the first in-phase reference voltage and is provided to the ports 39, 43 by the network 12.

For reasons similar to those given hereinbefore, the second quadrature field (FIG. 4, illustration (*d*)), is established in accordance with a second quadrature relationship which is given as:

$$V_{B2} = jA \sin \theta \tag{9}$$

where $V_{B2}$ is the strength of the second quadrature field.

Since the second reference and second quadrature voltages are both derived from the source 26, the second reference and second quadrature fields are additively combined in a manner represented by an addition of the terms of the second reference and the second quadrature relationships; the addition is in accordance with a second constant field relationship which is given as:

$$V_{C2} = V_{A2} + V_{B2} \tag{10}$$

$$= A \cos 2\theta + jA \sin 2\theta \tag{11}$$

$$= Aj2\theta \tag{12}$$

where $V_{C2}$ is the strength of the second constant field.

Since the second quadrature relationship is positive, the phase of the second constant field changes positively with respect to a direction of angular progression about the axis 10A from the port 36 to the port 37. However, the second constant field has the same strength (A) at all angles about the axis 10A whereby the strength of the second constant field is independent of angular position about the axis 10A. Accordingly, electromagnetic energy associated with the first and second constant fields propagates from the mode exciter 11A through the coupling assembly 11C to the mode exciter 11B.

Because the mode exciters 11A, 11B are similar, and the strengths of the first and second constant fields are independent of angular position about the axis 10A, field strength near the coaxial ports of the mode exciter 11B is substantially the same as field strength near the ports 36–43. Moreover, since the networks 12, 14 are bilateral, power provided at the terminals 28, 30 is substantially the same as power provided to the terminals 20, 22, respectively (independent of the rotational position of the mode exciter 11A relative to the mode exciter 11B).

From the description given hereinbefore, it should be understood that the reference and quadrature fields each define two cycles within the mode exciters 11A, 11B. However, in an alternative embodiment there may be any desired integral number of defined cycles. Because of the way that the fields are provided, a mode exciter has four coaxial ports for each defined cycle. Therefore, according to the present invention, a mode exciter has a number of ports in accordance with a relationship which is given as:

$$N = 4H \tag{13}$$

where

N is the number of ports in the mode exciter; and

H is the number of defined cycles.

Since the spacing between ports of a mode exciter is in accordance with the mode relationships (1) and (2), the maximum size of a mode exciter is directly related to the number of defined cycles. Therefore, according to principles of the present invention, there is no theoretical limit to the maximum size of a rotary joint.

Figure 5:
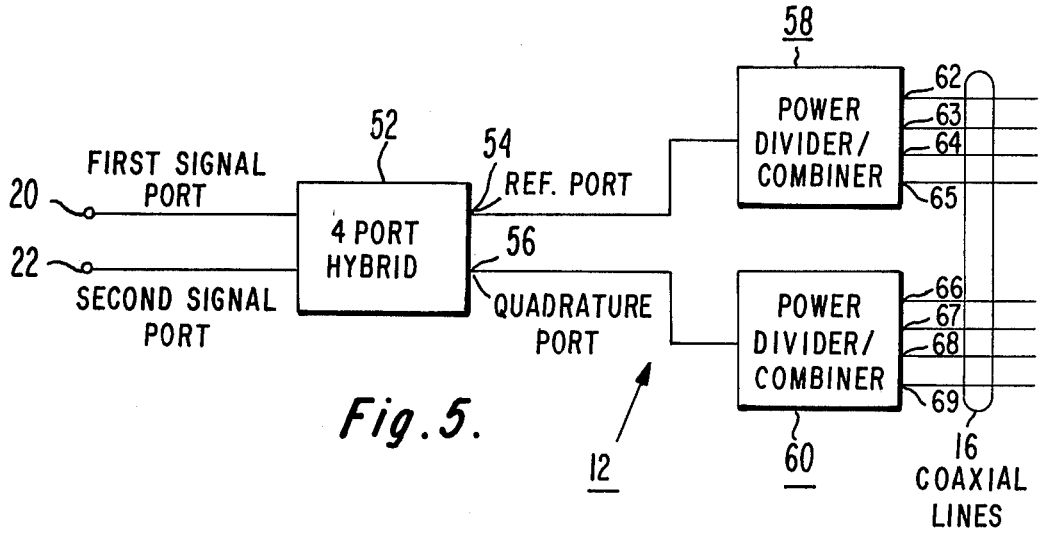
FIG. 5 is a block diagram of a bilateral network of the embodiment of FIG. 1.

Referring to FIG. 5, the network 12 (FIG. 1) includes a four port hybrid 52 having first and second signal ports connected to the terminals 20, 22, respectively. The source 24 provides the first in-phase reference voltage through the hybrid 52 to a reference port 54 thereof. Additionally, the first positive quadrature voltage is provided by the first hybrid 52 at a quadrant port 56 thereof. Similarly the source 26 provides the second in-phase reference voltage through the hybrid 52 to the port 54. Additionally, the second negative quadrature voltage is provided by the hybrid 52 at the port 56. The hybrid 52 is a type of bilateral network that is well known in the microwave art.

The ports 54, 56 are connected to inputs of similar power divider/combiner networks 58, 60, respectively, whereby reference voltages at the port 54 are provided by the divider/combiner 58 at ports 62, 63, thereof. Additionally, the first and second out-of-phase reference voltages are both provided by the divider/combiner 58 at ports 64, 65 thereof.

Similarly, the first positive and the second negative quadrature voltages at the port 56 are both provided by the divider/combiner 60 at ports 66, 67 thereof. Additionally, first negative and second positive quadrature voltages are both provided by the divider/combiner 60 at ports 68, 69 thereof.

It should be understood that in addition to the hybrid 52 being bilateral, the divider/combiners 58, 60 are bilateral. Therefore, the reference and quadrature voltages may be applied to the ports 62–69 to cause the hybrid 52 to provide power at the terminals 20, 22 similar to the power provided by the sources 24, 26, respectively. Since the networks 12, 14 (FIG. 1) are similar, power from the sources 24, 26 is transmitted through the rotary joint and the networks 12, 14 to loads (not shown) connected to the terminals 28, 30, respectively.

Figure 6:
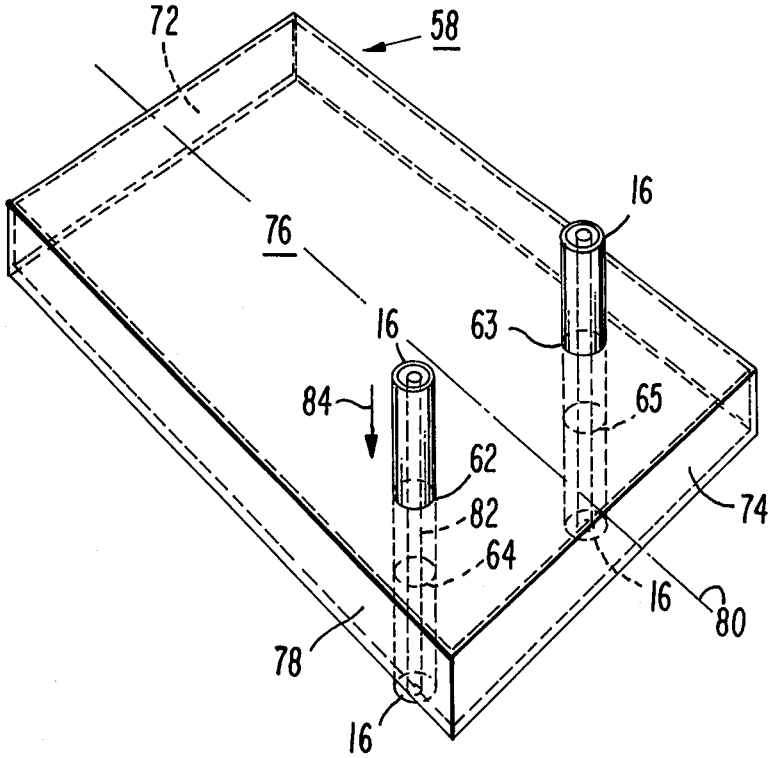
FIG. 6 is a perspective view of a power combiner/divider of the block diagram of FIG. 5.

Referring to FIG. 6, the divider/combiner 58 is shown as a rectangular waveguide having an open end 72 and a closed end 74. In this embodiment, the open end 72 is connected to the port 54 whereby the reference voltages are applied to the divider/combiner 58. In response to the application of the reference voltages, an electric field is established within the divider/combiner 58; the electric field has a $TE_{10}$ mode of propagation towards the closed end 74 from the open end 72.

The divider/combiner 58 has a top surface 76 wherein the ports 62, 63 are disposed. Additionally, the divider/combiner 58 has a bottom surface 78 wherein the ports 64, 65 are disposed opposite the ports 62, 63, respectively. The ports 62–65 are at a selected distance from the closed end 74 and equidistant from a central axis 80 of the divider/combiner 58.

In this embodiment, a connection to the ports 62, 64 (through a pair of the lines 16) utilizes a common central conductor 82. Therefore when a current through the conductor 82 is in a direction of arrow 84, the current flows into the divider/combiner 58 through the ports 62 and out of the divider/combiner 58 through the port 64. Therefore, the ports 62, 64 provide voltages that are out-of-phase with each other. In a similar manner, the ports 63, 65 provide voltages that are out-of-phase with each other. Because of the mode of propagation from the end 72 to the end 74, the inphase reference voltages are provided by the ports 62, 63 and the out-of-phase reference voltages are provided by the ports 64, 65; the quadrature voltages are provided by the divider/combiner 60 in a similar manner. In an alternative embodiment, the terminal 22 is connected to a terminating resistor instead of the source 26 whereby power from only the source 24 is transmitted through the rotary joint 10.

What is claimed is:

1. Apparatus that provides an interface of relative rotation for a transmission therethrough of microwave power from first and second signal sources, comprising:

similar first and second outer tubular conductors;

similar first and second inner tubular conductors coaxially disposed within said first and second outer conductors, respectively;

a substantially hollow coupling assembly that provides a noncontacting electrical coupling between proximal ends of said outer conductors and between proximal ends of said inner conductors with said first and second conductors in axial alignment and rotatable with respect to each other;

a number of ports disposed with equal arcuate spacing therebetween within each outer conductor approximately one-quarter of a wavelength associated with a voltage provided by one of said sources from the distal ends of said conductors, the number of said ports being in accordance with a relationship which is given as:

$N=4H$ where N is the number of said ports; and

H is an integer greater than one; and an electrically conductive ring connected to the distal ends of said first conductors.

2. The apparatus of claim 1 wherein said ports are adapted for connection to a coaxial cable.

3. The apparatus of claim 1 wherein said arcuate spacing and a distance that is between said first conductors and between said second conductors are in accordance with relationships which are given as:

$$\lambda/2 > b > \lambda/4$$

$$a < \lambda/2$$

where $p\ \lambda$ is said wavelength;

$b$ is said arcuate spacing; and $a$ is said distance.

4. The apparatus of claim 1 additionally comprising:

a first bilateral network connected to ports of said first outer conductor and having a pair of terminals adapted for connection to said first and second signal sources, respectively; and a second bilateral network connected to ports of said second outer conductor and having a pair of terminals that provide power derived from said first and second sources, respectively.

5. The apparatus of claim 4 wherein said networks are similar.

6. The apparatus of claim 4 wherein said first network provides four excitation signals of substantially equal amplitude that establish between said first conductors and between said second conductors a pair of electric fields having strengths that are independent of angular positions about the axis of said conductors, said excitation signals including:

(a) first and second in-phase reference signals of the same wavelengths as power provided by said first and second sources, respectively;

(b) first and second out-of-phase reference signals having phase angles of 180° from said first and second reference signals, respectively;

(c) a first pair of quadrature signals having phase angles of plus 90° and minus 90° with respect to said first and second reference signals, respectively; and (d) a second pair of quadrature signals having phase angles of minus 90° and plus 90° with respect to said first and second reference signals, respectively.

* * * * *